US008863638B2

(12) United States Patent
Lewis, III

(10) Patent No.: US 8,863,638 B2
(45) Date of Patent: Oct. 21, 2014

(54) BUSHING ASSISTED CAM PIN

(71) Applicant: Herbert Wilson Lewis, III, Macclesfield, NC (US)

(72) Inventor: Herbert Wilson Lewis, III, Macclesfield, NC (US)

( * ) Notice: Subject to any disclaimer, the term of this patent is extended or adjusted under 35 U.S.C. 154(b) by 143 days.

(21) Appl. No.: 13/687,004

(22) Filed: Nov. 28, 2012

(65) Prior Publication Data

US 2013/0239795 A1 Sep. 19, 2013

Related U.S. Application Data

(60) Provisional application No. 61/610,159, filed on Mar. 13, 2012.

(51) Int. Cl.

| | |
|---|---|
| ***F41A 3/00*** | (2006.01) |
| ***F41A 3/26*** | (2006.01) |
| ***F41A 3/68*** | (2006.01) |
| ***F41A 3/30*** | (2006.01) |

(52) U.S. Cl.

CPC ... *F41A 3/68* (2013.01); *F41A 3/26* (2013.01); *F41A 3/30* (2013.01)

USPC ..... 89/185; 89/191.01; 89/179; 89/194; 89/196; 42/16; 42/19; 42/69.02

(58) Field of Classification Search

CPC ..... F41A 3/16; F41A 3/26; F41A 3/28; F41A 3/68; F41A 5/18

USPC ..... 89/185, 191.01, 179, 194, 196; 42/16, 42/19, 69.02

See application file for complete search history.

(56) References Cited

U.S. PATENT DOCUMENTS

| | | | | |
|---|---|---|---|---|
| 3,618,457 | A * | 11/1971 | Miller | 89/185 |
| 3,648,562 | A | 3/1972 | Loeble | |
| 7,930,968 | B2 | 4/2011 | Giefing | |
| 2005/0223613 | A1* | 10/2005 | Bender | 42/16 |
| 2012/0216439 | A1* | 8/2012 | Barrett et al. | 42/75.02 |
| 2014/0144314 | A1* | 5/2014 | Jensen | 89/193 |

* cited by examiner

*Primary Examiner* — J. Woodrow Eldred

(57) ABSTRACT

A cam pin system, includes a cam pin comprising a first cylindrical portion having a first length and a first diameter and a second cylindrical portion concentric with the first cylindrical portion and having a second diameter larger than the first diameter, the second cylindrical portion comprising a through-hole to accommodate the passage of a firing pin. The system includes an end plate detachably connected to the first cylindrical portion of the cam pin, a cylindrical bushing encircling the first cylindrical portion and having an outside diameter approximately equal to the second diameter and a bushing length approximately equal to the first length, and lubricant between the cylindrical bushing and the first cylindrical portion. The cam pin system is configured so that the cylindrical bushing can rotate freely about the first cylindrical portion.

11 Claims, 2 Drawing Sheets

BUSHING ASSISTED CAM PIN

REFERENCE TO RELATED APPLICATION

This application claims priority to U.S. Provisional Patent Application No. 61/610,159, filed Mar. 13, 2012, entitled "Bushing Assisted Cam Pin."

BACKGROUND OF THE INVENTION

The present invention relates to a bushing assisted cam pin.

Cam pins in modern weapons, such as an AR-15, tend to wear down after substantial use due to metal-on-metal rubbing and contact. They must be replaced or else the firearm won't work properly.

There is a need for a cam pin that does not wear down as quickly or easily.

SUMMARY OF THE INVENTION

In one aspect of the present invention, a cam pin system comprises: a cam pin comprising a first cylindrical portion having a first length and a first diameter and a second cylindrical portion concentric with the first cylindrical portion and having a second diameter larger than the first diameter, the second cylindrical portion comprising a through-hole to accommodate the passage of a firing pin; an end plate detachably connected to the first cylindrical portion of the cam pin; a cylindrical bushing encircling the first cylindrical portion and having an outside diameter approximately equal to the second diameter and a bushing length approximately equal to the first length; and lubricant between the cylindrical bushing and the first cylindrical portion, wherein the cam pin system is configured so that the cylindrical bushing can rotate freely about the first cylindrical portion.

In one aspect, the end plate comprises a slot and the first cylindrical portion comprises a tang engagable in the slot. In one aspect, the first cylindrical portion comprises a slot and the end plate comprises a tang engagable in the slot.

In one aspect, the first cylindrical portion comprises a slot configured to contain the lubricant. In one aspect, the first cylindrical portion comprises a dimple configured to contain the lubricant. In one aspect, the cam pin system further comprises ball bearings located between the cylindrical bushing and the first cylindrical portion.

In one aspect, the end plate comprises a hole, the first cylindrical portion comprises a female threaded hole, and the cam pin system further comprises a screw, whereby the end plate is detachably connected to the first cylindrical portion of the cam pin via the screw.

In one aspect, the lubricant comprises a liquid. In one aspect, the lubricant comprises a solid. In one aspect, the lubricant comprises a nickel-boron coating on at least one of the first cylindrical portion and the cylindrical bushing.

In one aspect of the present invention, a firing pin system comprises: a firing pin; a bolt carrier; a bolt connected to the bolt carrier; and the cam pin system as described herein, wherein the firing pin passes through the through-hold and the bolt.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Broadly, an exemplary embodiment of the present invention generally provides a system for reducing friction. More specifically, an exemplary embodiment of the present invention provides a system of reducing friction for a cam pin system.

Figure 1:
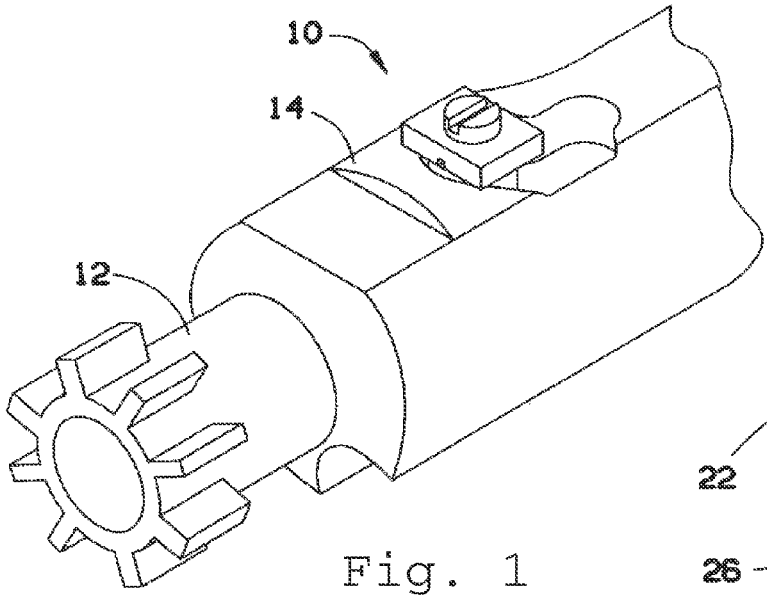
FIG. 1 is a perspective view of a bushing assisted cam pin according to one embodiment of the present invention in use.
Figure 2:
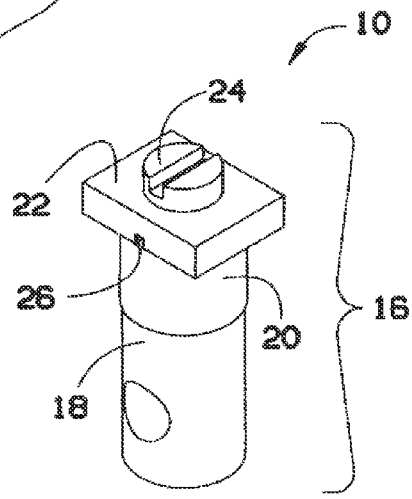
FIG. 2 is a perspective view of the bushing assisted cam pin according to one embodiment of the present invention shown in FIG. 1.
Figure 3:
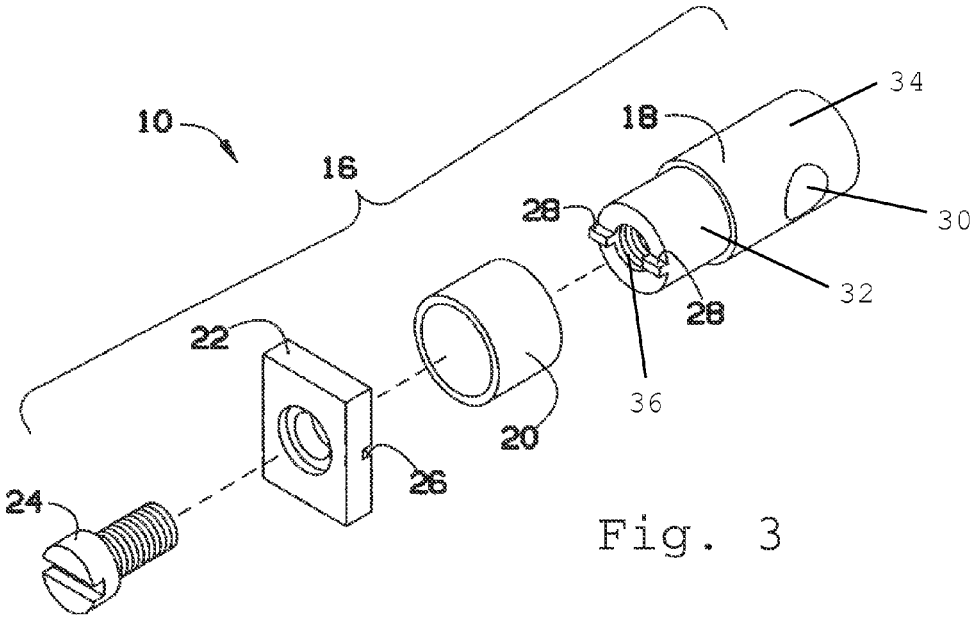
FIG. 3 is an exploded view of the bushing assisted cam pin according to one embodiment of the present invention shown in FIG. 1.
Figure 4:
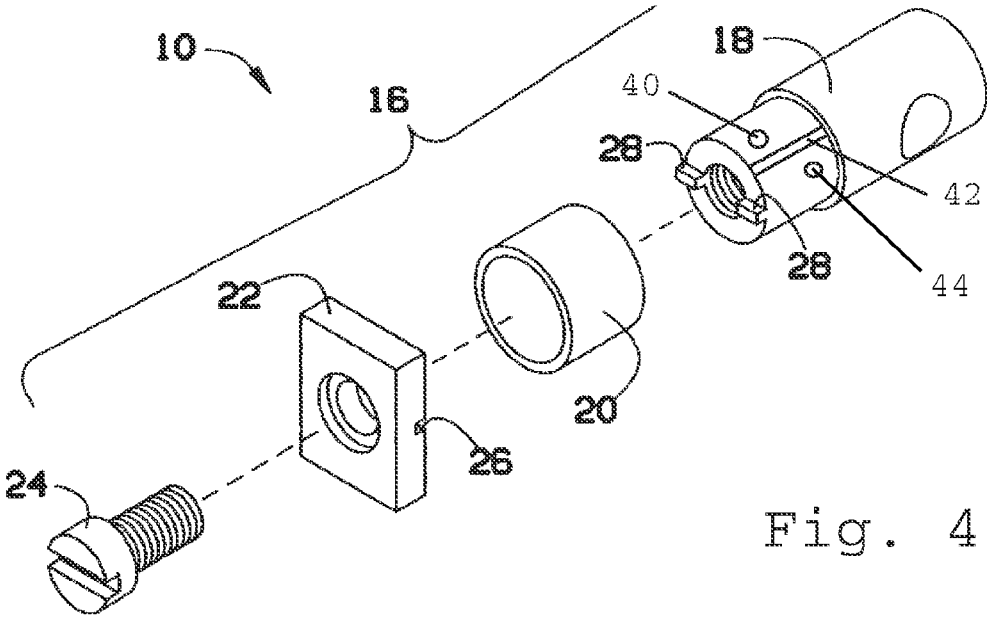
FIG. 4 is an exploded view of the bushing assisted cam pin according to one embodiment of the present invention shown in FIG. 1.

As shown in FIGS. 1-4, in one exemplary embodiment of the present invention 10, a cam pin system 16 may comprise an end plate 22, a cam pin 18, an anti-friction cylindrical bushing 20, and a fastening device, such as a screw 24, for example. The cylindrical bushing 20 may cover at least part of the cam pin 18. The screw 24 may be used to connect the end plate 22 and the anti-friction bushing 20 to the cam pin 18.

In one embodiment of the present invention, there may be a slot or notch 26 on the end plate 22 where a tang or protrusion 28 on the cam pin 18 may fit in the notch 26. The cam pin system 16 may be inserted into a bolt carrier 14 into which a bolt 12 may be inserted.

The present invention may reduce wear on the cam pin 18 that occurs during operation. More specifically, the bushing 20 may be added to the cam pin 18 where the friction occurs. The bushing 20 may rotate during operation and reduce friction and wear.

In another embodiment, a cam pin system 16 comprises: a cam pin 18 comprising a first cylindrical portion 32 having a first length and a first diameter and a second cylindrical portion 34 concentric with the first cylindrical portion 32 and having a second diameter larger than the first diameter, the second cylindrical portion 34 comprising a through-hole 30 to accommodate the passage of a firing pin; an end plate 22 detachably connected to the first cylindrical portion 32 of the cam pin 18; a cylindrical bushing 20 encircling the first cylindrical portion 32 and having an outside diameter approximately equal to the second diameter and a bushing length approximately equal to the first length; and lubricant between the cylindrical bushing and the first cylindrical portion, wherein the cam pin system 16 is configured so that the cylindrical bushing 20 can rotate freely about the first cylindrical portion 32. The inner diameter of the cylindrical bushing 20 may approximately match the diameter of the first cylindrical portion 32, with only a sufficient gap for lubricant and to allow free motion of the cylindrical bushing 20 about the first cylindrical portion 32.

The end plate 22 may take any shape but preferably has a larger cross section than that of the first cylindrical portion 32 so that the cylindrical bushing 20 is sandwiched (but not tightly) between the end plate 22 and the second cylindrical portion 34, allowing the bushing 20 to rotate freely (with low friction) but not to move substantially in a lateral direction. The end plate 22 may comprise a slot 26 and the first cylindrical portion 32 may comprise a tang 28 engagable in the slot 26, or these may be reversed. The invention may include two or more corresponding slots and tangs, configured to engage with each other to prevent rotational motion of the end plate 22 relative to the first cylindrical portion 32. Any other means of engaging these two pieces to prevent relative rotational motion is within the scope of the present invention.

The first cylindrical portion 32 may comprise one or more grooves or slots 42 configured to contain the lubricant. These slots 42 may be milled into the first cylindrical portion 32 to any desired depth, allowing lubricant to be contained and to allow free rotational motion of the cylindrical bushing 20. Alternatively or in addition, the first cylindrical portion 32 may comprise one or more dimples 40 configured to contain the lubricant, serving a similar purpose as the slots 42. Alternatively or in addition, the system 16 may further comprise ball bearings and/or bearing balls 44 located between the cylindrical bushing and the first cylindrical portion, rotatable to allow free (low-friction) rotation of the cylindrical bushing 20 about first cylindrical portion 32.

The end plate 22 may comprise a hole, the first cylindrical portion 32 may comprise a female threaded hole 36, and the cam pin system 16 may further comprise a screw 24, whereby the end plate 22 is detachably connected to the first cylindrical portion 32 of the cam pin 18 via the screw 24.

The lubricant may comprise a liquid, such as oil, grease, or any other known liquid lubricant to reduce friction. Alternatively or in addition, the lubricant may comprise a solid, such as graphite powder or any other known solid lubricant. Alternatively or in addition, the solid lubricant may comprise a coating, such as a nickel-boron coating on at least one of the first cylindrical portion and the cylindrical bushing.

A firing pin system according to the present invention may comprise: a firing pin; a bolt carrier 14; a bolt 12 connected to the bolt carrier 14; and the cam pin system 16 as described, wherein the firing pin passes through the through-hole 30 and the bolt 12.

It should be understood, of course, that the foregoing relates to exemplary embodiments of the invention and that modifications may be made without departing from the spirit and scope of the invention as set forth in the following claims.

What is claimed is:

1. A cam pin system, comprising:

a cam pin comprising a first cylindrical portion having a first length and a first diameter and a second cylindrical portion concentric with the first cylindrical portion and having a second diameter larger than the first diameter, the second cylindrical portion comprising a through-hole to accommodate the passage of a firing pin;

an end plate detachably connected to the first cylindrical portion of the cam pin;

a cylindrical bushing encircling the first cylindrical portion and having an outside diameter approximately equal to the second diameter and a bushing length approximately equal to the first length; and lubricant between the cylindrical bushing and the first cylindrical portion, wherein the cam pin system is configured so that the cylindrical bushing can rotate freely about the first cylindrical portion.

2. The cam pin system as claimed in claim 1, wherein the end plate comprises a slot and the first cylindrical portion comprises a tang engagable in the slot.

3. The cam pin system as claimed in claim 1, wherein the first cylindrical portion comprises a slot and the end plate comprises a tang engagable in the slot.

4. The cam pin system as claimed in claim 1, wherein the first cylindrical portion comprises a slot configured to contain the lubricant.

5. The cam pin system as claimed in claim 1, wherein the first cylindrical portion comprises a dimple configured to contain the lubricant.

6. The cam pin system as claimed in claim 1, further comprising ball bearings located between the cylindrical bushing and the first cylindrical portion.

7. The cam pin system as claimed in claim 1, wherein the end plate comprises a hole, the first cylindrical portion comprises a female threaded hole, and the cam pin system further comprises a screw, whereby the end plate is detachably connected to the first cylindrical portion of the cam pin via the screw.

8. The cam pin system as claimed in claim 1, wherein the lubricant comprises a liquid.

9. The cam pin system as claimed in claim 1, wherein the lubricant comprises a solid.

10. The cam pin system as claimed in claim 9, wherein the lubricant comprises a nickel-boron coating on at least one of the first cylindrical portion and the cylindrical bushing.

11. A firing pin system, comprising:

a bolt carrier;

a bolt connected to the bolt carrier; and the cam pin system as claimed in claim 1, wherein the firing pin system is configured to allow a firing pin to pass through the through-hole and the bolt.

* * * * *